United States Patent [19]

Waugh

[11] 4,402,199

[45] Sep. 6, 1983

[54] DIFFERENTIALLY DAMPED SUPPORT ASSEMBLY FOR WASHING MACHINE

[75] Inventor: Richard A. Waugh, Louisville, Ky.

[73] Assignee: General Electric Company, Louisville, Ky.

[21] Appl. No.: 301,487

[22] Filed: Sep. 14, 1981

[51] Int. Cl.[3] ..... D06F 37/24

[52] U.S. Cl. ..... 68/23.3; 68/23 R; 248/636; 248/663; 210/380.2; 384/244; 384/245

[58] Field of Search ..... 68/3 R, 23 R, 23.2, 68/23.3, 23.6, 23.7, 171, 172, 173, 174; 248/568, 636, 663; 210/249, 380.2; 384/242, 244, 245, DIG. 8, DIG. 7

[56] References Cited

U.S. PATENT DOCUMENTS

| | | | |
|---|---|---|---|
| 2,604,771 | 7/1952 | DeRemer | 68/172 X |
| 2,605,628 | 8/1952 | Smith | 68/23.6 X |
| 2,711,827 | 6/1955 | Smith | 210/380.2 |
| 4,333,322 | 6/1982 | Billings | 68/23.3 |

FOREIGN PATENT DOCUMENTS

| | | | |
|---|---|---|---|
| 1036159 | 9/1953 | France | 68/23.6 |

*Primary Examiner*—Philip R. Coe
*Assistant Examiner*—Frankie L. Stinson
*Attorney, Agent, or Firm*—Radford M. Reams; Frederick P. Weidner

[57] ABSTRACT

A support assembly for a washing machine includes a cabinet structure for enclosing the various working parts of the machine and a mount secured to the assembly of working parts of the machine for movement therewith. The cabinet base has an upwardly facing generally spherical bearing surface and the mount includes a generally spherical lower support surface. An intermediate member is positioned between the bearing surface and support surface and is formed with opposed spherical faces complimentary to the bearing surface and to the support surface respectively. A first relatively low coefficient of friction interface is provided between the intermediate member and one of the bearing and support surfaces and a relatively high coefficient of friction interface is provided between the intermediate member and the other of the bearing and support surfaces so that relative motion between intermediate member and either of the base and the mount respectively in response to movement of the mount tends to occur at the low coefficient of friction interface. The intermediate member has an interfering engagement with the one of the base and the mount with which it has the low coefficient of friction interface upon predetermined movement of the mount so that relative movement between intermediate member and either of the base or the mount in response to greater than the predetermined movement of the mount occurs at the high coefficient of friction interface.

9 Claims, 7 Drawing Figures

DIFFERENTIALLY DAMPED SUPPORT ASSEMBLY FOR WASHING MACHINE

BACKGROUND OF THE INVENTION

It is well known to provide a support assembly for the mounting or suspension of the operating components of clothes washing machines, which assembly moves in a nodal fashion in damping out undesirable movement of the operating components of the machine. A number of such mounts or suspensions have been or currently are in production by various manufacturers of upright washers. The support assembly has two, somewhat conflicting, objectives. A general object of such assemblies is to minimize the unbalance forces exerted on the cabinet at the pivot or nodal point of movement. Such unbalance forces tend to cause vibration of the floor and movement or walking of the washing machine. A second object is to control excursion of the working components of the machine, particularly the clothes basket or receptacle, during the spin operation. Such excursions may be particularly large as the clothes receptacle passes through what is called the "critical" speed. In order to centrifugally extract the maximum amount of water from the fabrics which have been washed, the basket is rotated at very high speed. In the critical speed range of the basket the excursion of the basket caused by unbalances tends to become regenerative and the basket tries to move far off its central axis. This can cause the basket to strike other components of the machine and damage the machine. The support assembly applies a frictional force opposing such large excursions, particularly as the receptacle passes through its critical speed range. Thus it can be seen that the object of isolating unbalance forces from the cabinet is enhanced by reducing as much as possible the frictional forces present in the support assembly while damping unwanted large excursions is enhanced by increasing the frictional forces opposing the excursion. While many support assemblies have been utilized in the industry, none has been completely satisfactory.

SUMMARY OF THE INVENTION

It is therefore an object of the present invention to provide a new and improved support assembly for upright washing machines.

It is another object of the present invention to provide such an improved support assembly of the fixed node type which provides differentiated damping forces in response to differing excursions of the working components of the machine.

It is yet another object of the present invention to provide such an improved support assembly which is simple in construction.

In accordance with one embodiment of the present invention there is provided a support assembly for a washing machine having an assembly of working parts for effectively washing fabrics in a liquid and extracting liquid from the fabrics. The support assembly includes a cabinet structure housing the working parts and having a base including a generally spherical bearing surface for pivotally supporting the assembly of working parts. A mount is secured to the assembly of working parts for movement therewith during operation of the machine and includes a generally spherical lower support surface. An intermediate member is positioned between the bearing surface and the support surface and is formed with opposed generally spherical faces complementary to the bearing surface and support surface respectively. A first, relatively low coefficient of friction, interface is provided between the intermediate member and one of the bearing and support surfaces and a second, relatively high coefficient of friction, interface is provided between the intermediate member and the other of the bearing and support surface so that relative motion between the intermediate member and either of the base or the mount respectively in response to movement of the mount tends to occur at the first interface. The intermediate member has an interfering engagement with the one of the base and the mount with which it has the first interface upon a predetermined amplitude of movement of the mount so that relative movement between the intermediate member and either the base and mount in response to greater than the predetermined movement of the mount occurs at the second interface.

The above mentioned and other features and objects of this invention will become more apparent, and the invention itself will be more fully understood by reference to the following description, taken in conjunction with the accompanying drawings wherein:

DESCRIPTION OF THE PREFERRED EMBODIMENTS

Figure 1:
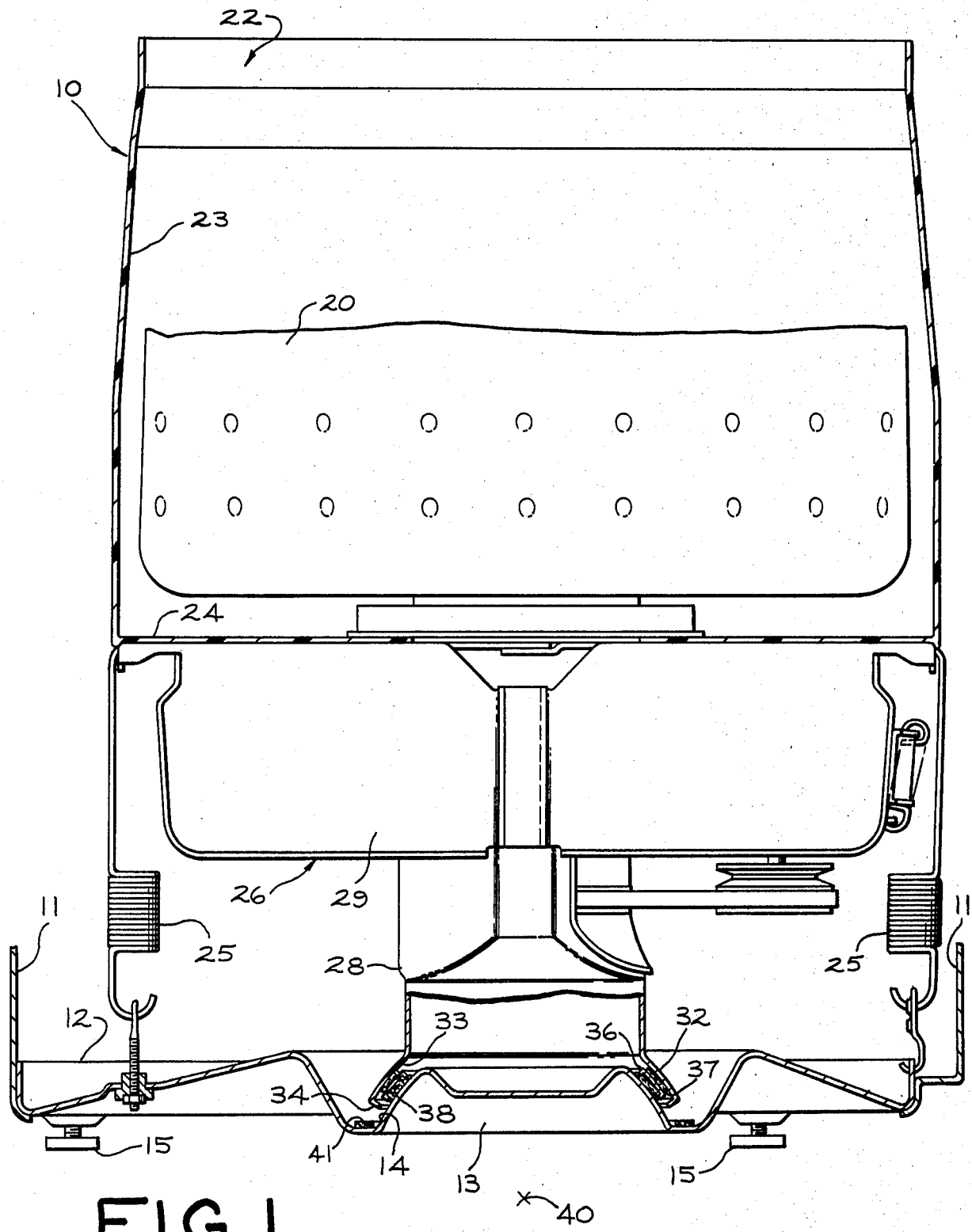
FIG. 1 is a simplified, schematic, cross-sectional elevational view of a fabric washing machine incorporating one form of the present invention, with some parts of the machine omitted for the sake of simplicity.

Referring to the drawings, there is shown in FIG. 1 a washing machine 10 of the upright or vertical axis type including a cabinet having sidewalls 11 and a top, which has been omitted for the sake of simplicity. The cabinet also includes a base or bottom frame 12 formed at its center with a portion 13 having an upwardly projecting, generally spherical bearing surface 14 for supporting the assembly of working parts of the machine. The generally spherical bearing surface 14 provides a mount or suspension of the fixed node type. That is, the mechanism mounted on portion 14 will move about the center of the sphere of which surface 14 is a part. It will be understood that "spherical" is used herein in its general sense, including both structures having the form of a sphere and structures having the form of a segment of a sphere.

A number of support feet 15 are threadedly engaged in the bottom frame 12. The height of each individual foot can be adjusted in order that the base or bottom frame 12 will have a level or horizontal disposition even though the support surface on which the machine is mounted may not be horizontal.

The illustrative washing machine is of the orbital type, containing a perforate basket or receptacle 20 which receives fabrics to be washed. During the washing steps or phases of operation the basket 20 is caused to orbit about the central vertical axis of the machine. This agitates the fabrics in water and detergent or the clean water, respectively, received in the basket. The basket is rotated or spun about the vertical axis in order to centrifugally extract liquid from the fabrics. The basket 20 is received in an imperforate, stationary or nonrotatable tub 22 having an upright peripheral sidewall 23 and a generally horizontal bottom wall 24. The tub 22 is received in the cabinet of the washing machine. Additional details of the construction and operation of an orbiting type washing machine may be had by reference to the copending application of John Bochan, Ser. No. 142,949, filed Apr. 23, 1980, Patent No. 4,328,600, and assigned to General Electric Company, assignee of the present invention, which application is incorporated herein by reference. It will be understood that, while the illustrative washing machine is of the orbiting type, the present invention is useful in other types of upright washing machines, such as wobble washers and agitator type washers.

The assembly of working components of the machine are pivotally supported by mount 26, including a hollow upright mounting post 28. Attached to the upper end of the mounting post by suitable means such as welding is a tub support structure 29 which conveniently may have three generally radially extending arms having flat upper portions on which the tub 22 is mounted. The tub may be mounted to the support structure 29 by suitable means such as bolts, which have been omitted for simplicity. The arms of the tub support also form the support for various components of the machine, such as the transmission and the drive motor, and for counterweights used to evenly distribute the weight applied to the post 28. While such components have been omitted from FIG. 1 for the sake of simplicity, additional details of a mounting arrangement, as shown in FIG. 1, may be had by reference to copending application of Billings et al., Ser. No. 215,217, filed Dec. 11, 1980, Patent No. 4,333,322, and assigned to General Electric Company, assignee of the present invention, which application is incorporated herein by reference.

The lower portion of post 28 is generally cylindrical in cross section and its lower end is formed into a support portion 32 having a downwardly facing generally spherical support surface 33 complimentary to the bearing surface 14. The extreme lower edge of the support portion 32 is turned inwardly to form a flange 34. An intermediate member 36 is interposed between the bearing surface 14 of base 12 and the support surface 33 of post 28. An annulus 37 of material of relatively low coefficient of friction is positioned between the intermediate member 36 and the support surface 33. An annulus 38 of material of relatively high coefficient of friction is positioned between the intermediate member 36 and the bearing surface 14. For example, the annulus of material 37 can be tetrafluoroethylene and the annulus 38 can be lubricated wool felt. In the illustrative machine, the annulus 37 is attached to the bearing surface 33 and rubs against the upper surface of the intermediate member 36 and the annulus 38 is attached to the lower side of the intermediate member 36 and rubs against the bearing surface 14. However, each of the annuluses may be attached to either of the members with which it is associated so long as it is sized to accommodate the relative movement between the associated surfaces.

Springs, such as those shown at 25, connect the mount 26 to the base 12. The springs 25 bias the moving structure of the machine so that the post 28 tends to center itself on the bearing surface 14. The springs also help prevent the mount from bouncing or lifting from the base during operation.

Figure 2:
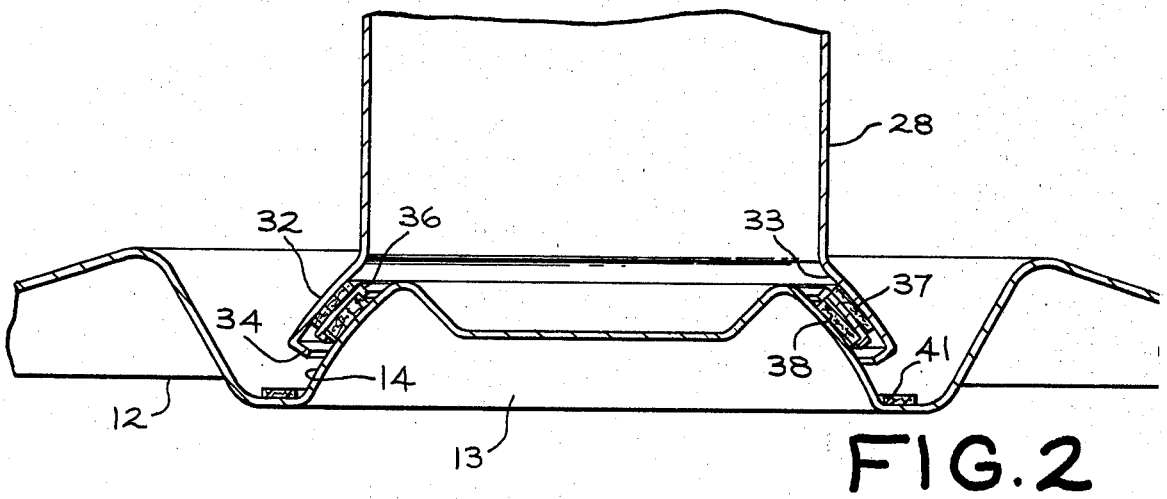
FIG. 2 is an enlarged fragmentary elevational view of a portion of the machine of FIG. 1 showing some of the components of the support assembly in a centered or upright position.
Figure 3:
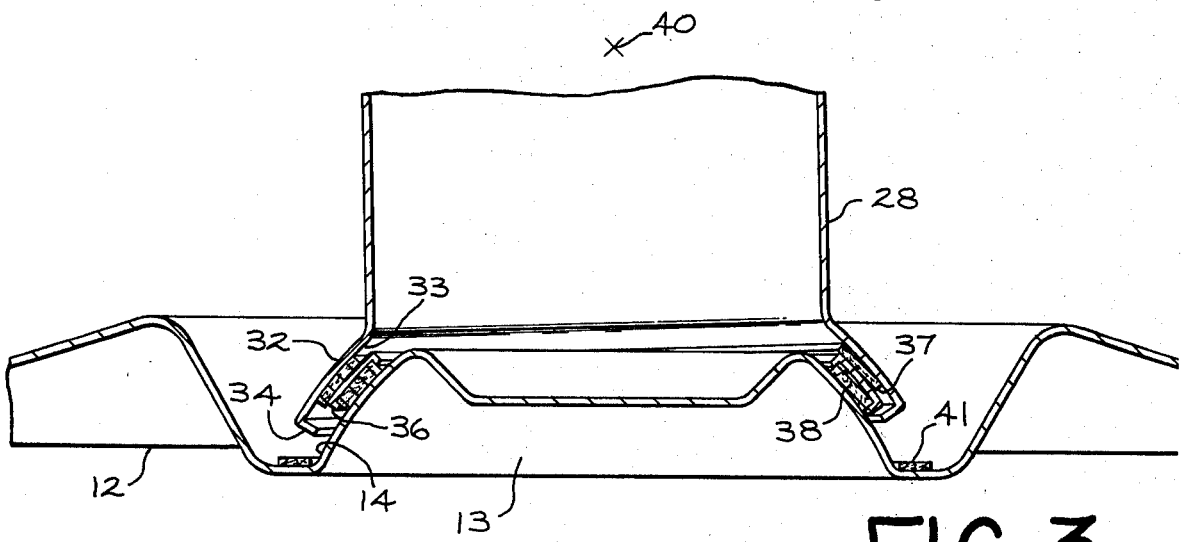
FIG. 3 is a view similar to FIG. 2 but with the mount slightly off center.
Figure 4:
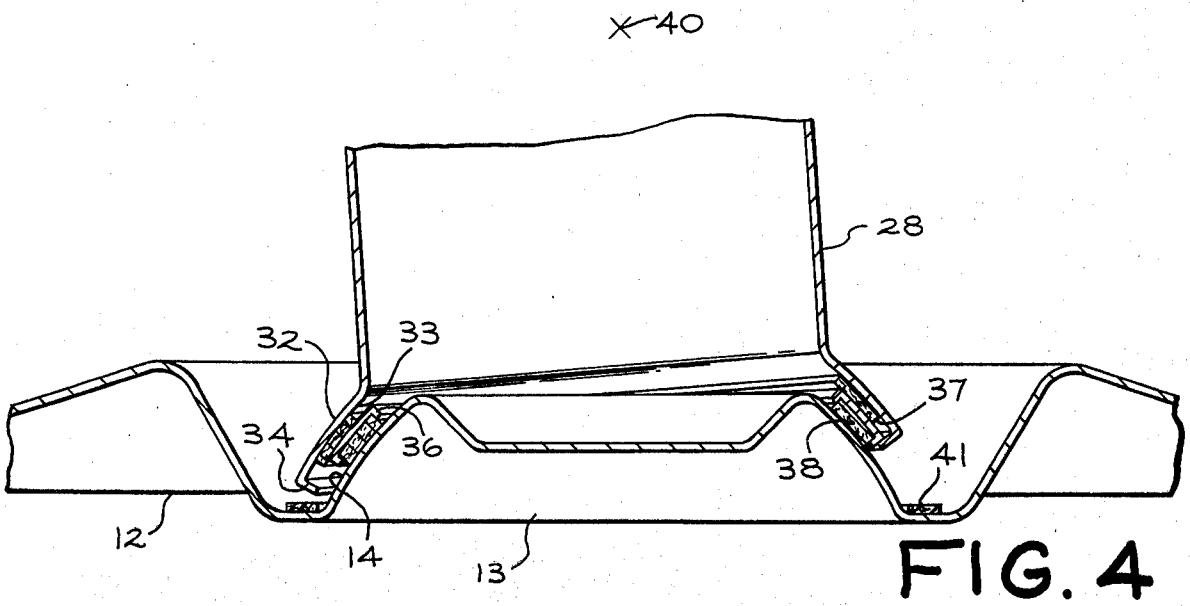
FIG. 4 is a view similar to FIG. 2 but with the mount in a more extreme off centered position.

Referring now to FIGS. 2–4, the functioning of the support assembly during operation of the machine will be described. FIG. 2 shows the nominal position of the mount 28 relative to the base with the machine off. In this position the mount is centered on the bearing surface 14 and extends generally vertically. The intermediate member 36 also is centered on the bearing surface 14 and the lower annular ledge of member 36 is spaced from the flange 34 of the mount 28. The bearing surface 14, support surface 33 and intermediate member 36 are segments of three concentric spheres which have a common center. The common center of those spheres define nodal point 40. Relative movement between mounting post 28 and intermediate member 36 or between intermediate member 36 and bearing surface 14 will result in post 28 moving about node 40.

During washing and rinsing operations the mount 28 will tend to move about the node 40 with excursions of relatively low radius. Since the coefficient of friction of the interface between annulus 37 and intermediate member 36 is lower than the coefficient of friction between the annulus 38 and bearing surface, the small radius excursions of mount 14 are accompanied by relative movement between the support surface 33 and the intermediate member 36. FIG. 3 shows the mount in one such slightly off center position.

When the excursion or tipping of the mount 28 becomes sufficiently large the flange 34 engages the annular edge of the intermediate member 36, as shown in FIG. 4. Additional movement of the mount 28 in that direction, for instance to the left as seen in FIG. 4, causes relative motion to occur between the intermediate member 36 and the bearing surface 14 rather than between intermediate member 36 and the support surface 33. Since the annulus 38 provides a relatively high coefficient of friction this large amplitude movement of the post 28 is resisted or damped. An annulus of damping or cushioning material 41 is provided around the base of the bearing surface 14 and is engaged by the lower surface of flange 34 should the post have an extremely large excursion. The large amplitude excursions of mount 28 tend to occur during centrifugal extraction and are most pronounced when the rotation is in the critical speed range for the particular suspension.

It will be understood that the low coefficient of friction interface provided between the intermediate member 36 and the support surface 33 minimizes transfer of forces from the moving system of the washer to the base during most of the operations of the washing machine. This minimizes vibration of the floor and walking of the machine. However, if the excursions of the mount 28 become too large, as when the basket 20 approaches critical speed during spin, the flange 34 and intermediate member 36 engage so that the relative motion involves a relatively high coefficient of friction material 38. This applies a significant damping force which acts as a control on the unwanted large excursions. The effect of the friction forces on the base can be minimized by locating the node 40 so that it approximates the natural mode of movement of the suspended system of the machine. When the basket 20 is rotated the assembly of moving parts tends to move about some point on the extension of the vertical axis of the machine. This point is called the "natural" node of operation. In many present day washing machines, the natural node is below the surface on which the machine is mounted. The natural node for any machine may vary slightly with load but the effect on the cabinet of the damping friction will be minimized if the location of the node 40 approximates the location of the natural node.

Figure 5:
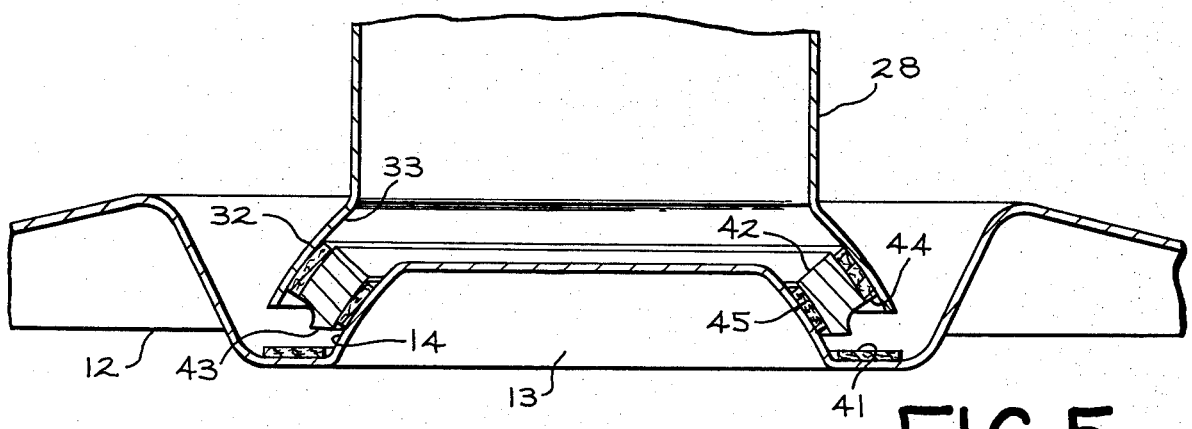
FIG. 5 is a view similar to FIG. 2 showing a portion of a support assembly incorporating another embodiment of the present invention.
Figure 6:
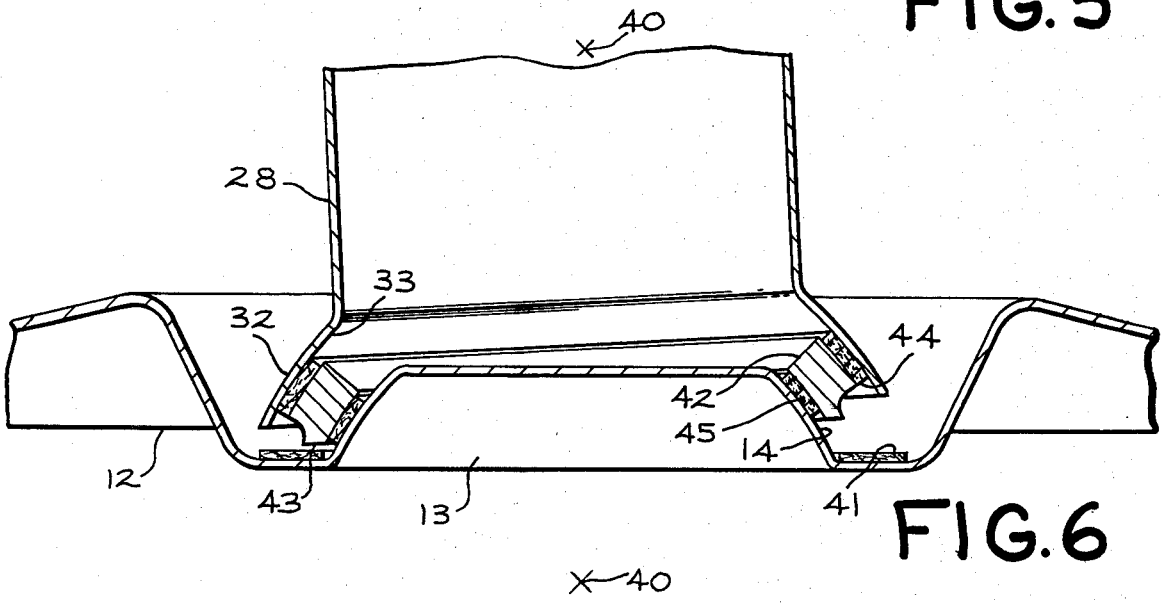
FIG. 6 is a view similar to FIG. 5 but showing the mount slightly off center.
Figure 7:
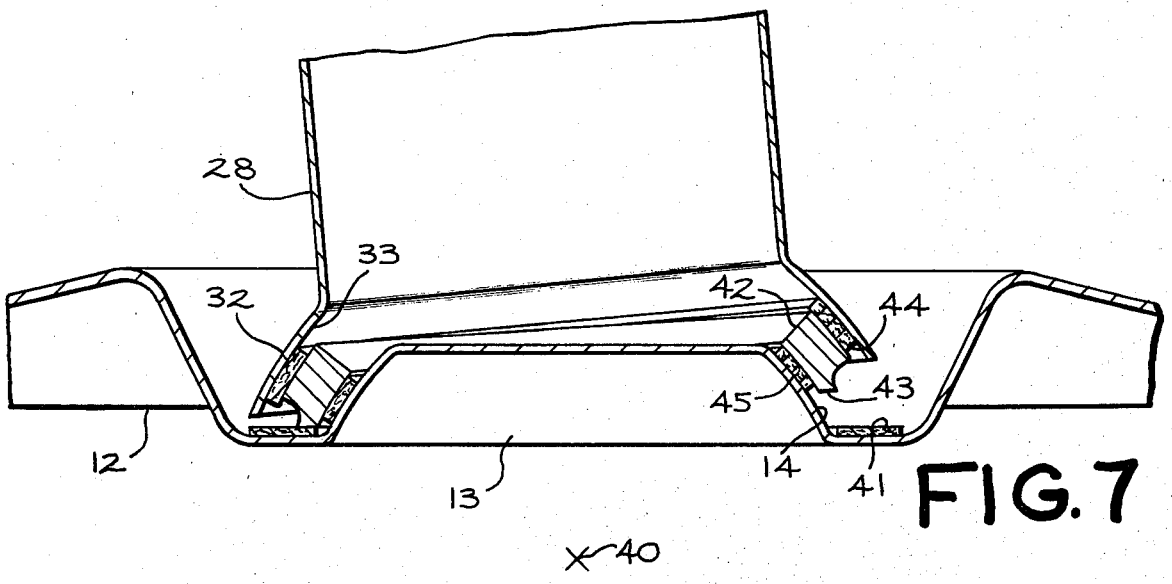
FIG. 7 is a view similar to FIG. 5 but showing the mount further off center.

FIGS. 5, 6 and 7 illustrate a modification of the support assembly incorporating another embodiment of the present invention. In describing FIGS. 5–7 like numerals are used to identify corresponding parts.

The intermediate member 42 is thicker than the member 36 and includes a downwardly facing flange 43 for engaging the cushioning ring 41. The annulus 44 between the intermediate member 42 and the bearing surface 33 has a relatively high coefficient of friction and is attached to the intermediate member. The annulus of material 45 between intermediate member 42 and the bearing surface 14 has a relatively low coefficient of friction and it too is attached to the intermediate member. As the mount 28 moves during operation of the machine the intermediate member 42 tends to move with it and relative motion occurs between intermediate member 42 and the bearing surface 14, as shown in FIG. 6. When the mount and intermediate member move off center a sufficient amount the shoulder 43 of intermediate member 42 engages the cushioning ring 41, as shown in FIG. 7. Further movement of the mount 28 results in relative motion between the bearing surface 33 and the intermediate member 42 also as shown in FIG. 7.

The support assembly of FIGS. 5–7 has an additional improvement over the embodiment shown in FIGS. 1–4 in that the radius from the node 40 to the high friction damping interface between annulus 44 and intermediate member 42 is longer than the radius to the low friction interface between the annulus 45 and bearing surface 14. Thus the high friction movement occurs at the longer radius. On the other hand, in the construction shown in FIGS. 1–4 the high friction interface is at the shorter radius. By way of example, a washing machine of an overall size typical for today's commercially available washers was constructed and operated with a support assembly as illustrated in FIGS. 5–7, in that machine the radius to bearing surface 14 was about three inches and the radius to the annulus 44 was about five inches. This two inch difference in radius provided a significant increase in the damping torque applied about node 40 during large excursions of the mount 28. It will be understood that the longer the radius to annulus 114 and the shorter the radius to the bearing surface 14 the greater will be the difference in the applied torque.

While in accordance with patent statutes I have described what at present is considered to be preferred embodiments of this invention, it will be obvious to those skilled in the art that various changes and modifications may be made therein without departing from the invention and is intended in the following claims to cover all such equivalent variations as fall within the true spirit and scope of the invention.

What is claimed is:

1. A support assembly for a washing machine having an assembly of working parts for effecting washing of fabrics in a liquid and extraction of liquid from the fabrics, the support assembly comprising:

a cabinet structure housing said assembly of working parts, said cabinet structure having a base including a generally spherical bearing surface for pivotally supporting said assembly of working parts;

a mount secured to the assembly of working parts for movement therewith during operation of said machine and including a generally spherical lower support surface;

an intermediate member positioned between said bearing surface and said support surface and formed with opposed generally spherical faces complimentary to said bearing surface and said support surface respectively;

means for providing a first, relatively low coefficient of friction, interface between said intermediate member and one of said bearing and support surfaces and means for providing a second, relatively high coefficient of friction, interface between said intermediate member and the other of said bearing and support surfaces; so that relative motion between said intermediate member and either of said base and said mount respectively in response to movement of said mount tends to occur at said first interface;

said intermediate member having an interfering engagement with the one of said base and said mount with which it has said first interface upon a predetermined amplitude of movement of said mount so that relative movement between said intermediate member and either of said base and mount in response to greater than the predetermined movement of said mount occurs at said second interface.

2. A support assembly as set forth in claim 1 wherein said bearing surface, support surface and said faces of said intermediate member are formed about a common center defining a nodal point for said machine.

3. A support assembly as set forth in claim 1 wherein said first, relatively low coefficient of friction interface is provided between said intermediate member and the one of said bearing surface and said support surface positioned radially inward of said intermediate member.

4. A support assembly as set forth in claim 1 wherein said first, relatively low coefficient of friction, interface is provided between said bearing surface and said intermediate member.

5. A support assembly as set forth in claim 1 wherein said intermediate member has an interfering engagement with said base upon predetermined amplitude movement of said mount.

6. A support assembly as set forth in claim 1 wherein said mount has an interfering engagement with said base upon predetermined amplitude movement of said mount.

7. A support assembly as set forth in claim 1 further including spring means biasing said mount and base together.

8. A support assembly for a washing machine having an assembly of working parts for effecting washing of fabrics in a liquid and extraction of liquid from the fabrics, the support assembly comprising:

a cabinet structure housing the assembly of working parts, said cabinet structure having a base including an upwardly projecting generally spherical bearing surface for pivotally supporting said assembly of parts:

a free floating intermediate member formed with opposed generally spherical faces complimentary to said bearing surface and slidably mounted on said bearing surface;

a mount secured to the assembly of working parts for movement therewith during operation of said machine and including a generally spherical lower support surface complimentary to the upper face of said intermediate member; said mount being positioned with said support surface slidably mounted on said intermediate member;

means providing a first, relatively low coefficient of friction, interface between said intermediate member and said bearing surface; and means providing a second, relatively high coefficient of friction, interface between said intermediate member and said support surface so that said intermediate member moves with said mount about said bearing surface as said mount moves with said assembly of washing parts;

said intermediate member coming into interfering engagement with said base upon a predetermined amplitude of movement of said mount so that movement of said mount greater than the predetermined amplitude results in relative movement between said intermediate member and said mount.

9. A support assembly as set forth in claim 1 for a washing machine in which the assembly of working parts has a natural node of operation during centrifugal extraction and wherein said bearing surface, said support surface and said intermediate member define a node of movement of said intermediate member relative to either of said base and said mount which approximates the natural node of operation.

* * * * *